US005263434A

United States Patent [19]

Mashburn et al.

[11] Patent Number: 5,263,434

[45] Date of Patent: Nov. 23, 1993

[54] OUTRIGGING APPARATUS FOR BOATS AND THE LIKE

[76] Inventors: James S. Mashburn; Jerry P. Mashburn, both of 213 Rivo Alto Canal, Long Beach, Calif. 90803

[21] Appl. No.: 930,323

[22] Filed: Aug. 14, 1992

[51] Int. Cl.[5] ..... B63B 17/00

[52] U.S. Cl. ..... 114/364; 114/123

[58] Field of Search ..... 114/122, 123, 126, 244, 114/245, 311, 230, 221 R, 364

[56] References Cited

U.S. PATENT DOCUMENTS 4,061,102 12/1977 Bissett ..... 114/126

FOREIGN PATENT DOCUMENTS 713761 2/1980 U.S.S.R. ..... 114/123

1595242 8/1981 United Kingdom ..... 114/126

*Primary Examiner*—Jesûs D. Sotelo

[57] ABSTRACT

An apparatus for laterally bracing and/or suspending outboard rigging from the sides of floating vessels and the like. The outrigging apparatus comprises a spar with a padded end at its base and an outer end that includes a bore for reeving the outboard rigging, especially roll-dampening devices. The spar sets mainly below the rail of the vessel and is supported by a harness which provides the spar stability on the hull-side of the vessel, where it extends perpendicular to the hull-side, and at some inclination from the base. When a load is applied to the outboard end of the spar it is balanced statically between tensions in the harness and compression along the spar. The basal pad mitigates the resultant pressure on the hull where it contacts the topside. Only two existing attachment sites are required onboard the vessel, one to each side of the extended spar. Whereas the spar is not permanently attached to the vessels' side, it is quickly and universally deployable.

14 Claims, 2 Drawing Sheets

OUTRIGGING APPARATUS FOR BOATS AND THE LIKE

BACKGROUND OF THE INVENTION

1. Field of the Invention

The present invention relates to specialized spars and spar arrangements, and in particular to special spar arrangements projecting laterally from the sides of boats or floating platforms to brace and/or suspend outboard rigging.

2. Description of the Prior Art

As is well known in the art, the use and adaptation of spars to brace or suspend outboard rigging is an ancient practice. Various arrangements of hardware, rope and/or wire-lines suited to extend a spar perpendicularly from a vessels side have been utilized conforming to each particular vessels structure, available rigging, and the discretion of the vessel owner or professional rigger.

These outrigging arrangements are characterized by the use of special hardware to secure the butt-end of the spar to some part of the vessels side, while the outboard end of the spar is supported by rigging. At present, the most prevalent single outrigging application is to outwardly suspend a submerged roll-dampening device. By outrigging the device as far from the boats, side as possible the roll dampening torque on the boat is greatly amplified. Prior solutions for outriggers fall into two main categories, the temporary adaptation of a boats extant rigging, or fitting the boat with custom outrigging systems.

Many vessels, especially sailing vessels, have spars and struts that can be adapted to function as outriggers. A boom or spinnaker pole can be fastened at their inboard ends to their usual locations on a mast, and positioned to project out over the water off the side of the boat. The outboard end of the boom or pole can be stationed in place by lifting rigging to hold it up, and forward and rearward tending rigging to restrict horizontal movement. Outboard rigging such as the roll dampener can then be lead off the outboard end of the boom or pole.

Many other boats, especially powerboats, may lack the extant rigging of sailboats, therefore the carrying of spars and rigging for the single purpose of outrigging becomes necessary. Usually hardware to connect the inboard end of a spar is permanently attached to the side, gunwale, railing, or super structure. Other hardware is attached above, forward, and rearward of the inboard attachment hardware to fasten the outboard stationing rigging.

Disadvantages of adapting extant spars and rigging include the time required to adapt the rigging, the inconvenient running of associated rigging across useable deck areas, and the fact that rigging is tied up which may need to be quickly used in an emergency. The disadvantages of a custom system which could be made to overcome the above mentioned disadvantages, is largely in the area of cost. Any custom rigging is expensive in parts and installation, and may involve undesirable hardware on the hull sides.

OBJECTS AND ADVANTAGES OF THE INVENTION

The present invention comprises a novel arrangement for a complete outrigger apparatus which is designed to quickly set below the rail on the sides of any vessel, and reliably brace outboard rigging without requiring special hardware. The outboard rigging being braced may include any number of submersible devices such as game cages and roll-dampening devices, and may include as well floating objects such as a dinghy. The outrigger is defined by a spar member and tethers attaching at each end of the spar member. The spar member is a spar including at one end a padded basal portion and a through-bored end ca at the other. The tethers attaching near the basal portion of the outrigger, hereinafter referred to as basal tethers, lead upwards attaching to convenient sites at or above the rail on opposite sides of the outrigger. The tethers attaching through the end cap, hereinafter referred to as outer tethers, lead back and up to the two basal tether attachment sites and act to station the outer end of the outrigger so that the outrigger extends perpendicularly from the boats side with the outer end higher than the basal end.

In this deployed configuration the apparatus stations on the portion of the hull sides below the rail and above the waterline hereinafter referred to as the topsides. Outboard rigging leads through the bore in the end cap. Gravity or outboard rigging weights the outer end of the outrigger which pulls against the outer tethers compressing the spar and pressing the basal pad against the vessels topside. The pad is stationed by the basal tethers and a shear friction against the topside surface. It is therefore an object of the outrigger apparatus to be self-stationing substantially below the rail, with only two points on the boat needed to tie to.

The present invention can be deployed in any convenient location along the topsides of any vessel, with the two attachment sites being any existent rail or deck hardware that a rope can be tied onto. Therefore as an important object the invention requires no installation of special hardware, and is complete and ready to use on any vessel. An additional advantage includes lower cost by virtue of production manufacturing, since the invention is universally useable. With the apparatus setting entirely below the rail, no deck space is obstructed by peripheral rigging, and emergency operation of the vessel is not hindered. An advantage of having an outrigged spar that is not fastened to the topside surface is instant retrieval or deployment of the spar member by simply lifting or setting it over the rail.

Further, the present invention is of light weight and is easily handleable. By making the spar telescopic the inventions' stowability is enhanced. Simple design and construction with non corrosive materials make the present invention durable and low in maintenance with high longevity in the marine environment. The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements of modes of operation that are properly within the scope of the appended claims.

BRIEF DESCRIPTION OF THE DRAWINGS

Novel features and advantages of the present invention, in addition to those mentioned above, will become apparent to those skilled in the art from reading the following detailed description in conjunction with the accompanying drawings wherein.

DESCRIPTION OF THE PREFERRED EMBODIMENT

Figure 1:
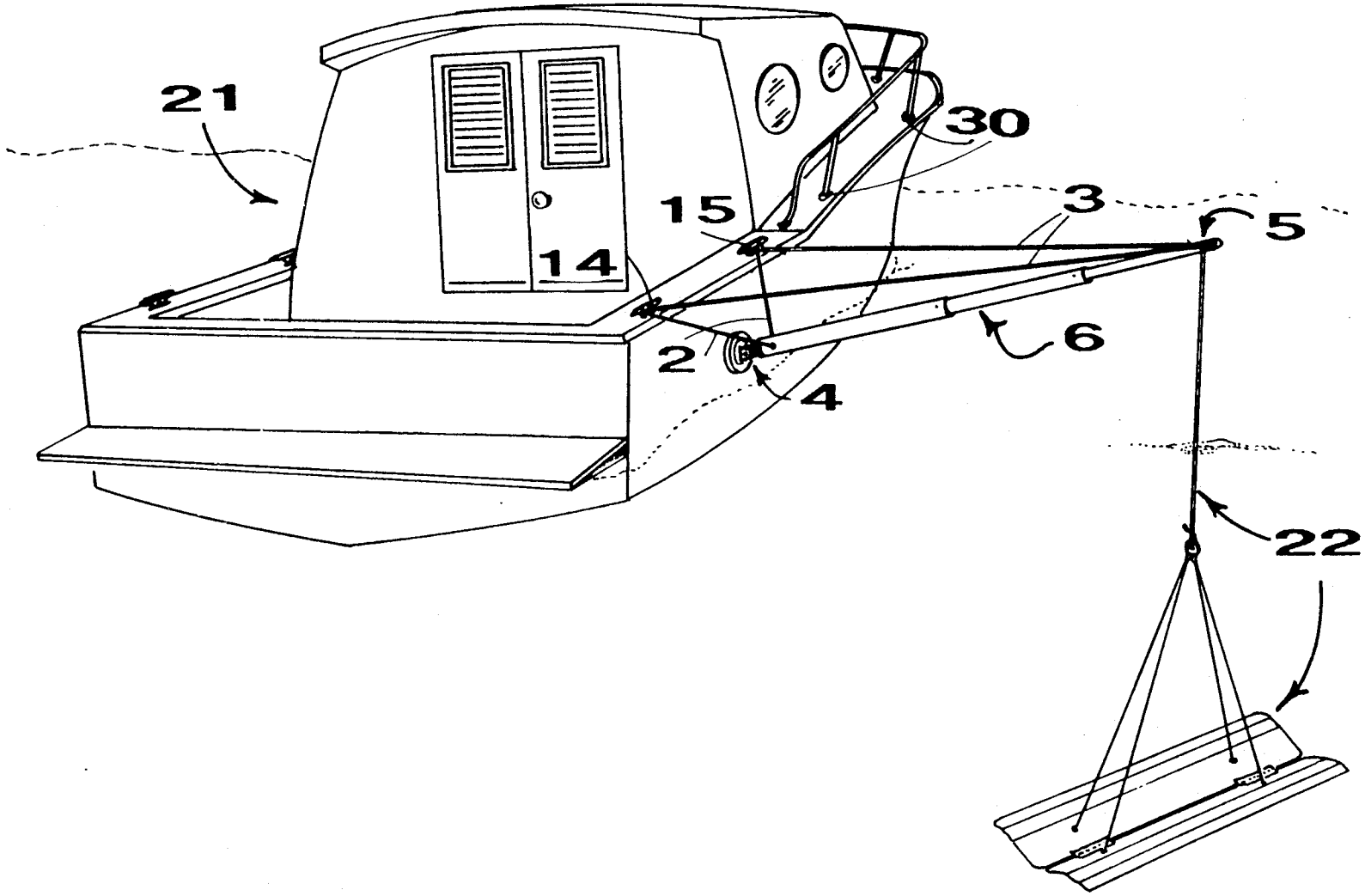
FIG. 1 is a pictorial view of the outrigging apparatus deployed on the starboard side of a vessel that might be adrift or anchored, wherein the outrigging apparatus is supporting a submerged roll-dampening device.

Referring to FIG. 1, there is shown a floating vessel generally indicated at 21 with the present invention deployed from the starboard topside to usefully outrig an outboard device and rigging attached thereto generally indicated at 22. The apparatus illustrated between the vessel 21 and the outboard rigging 22 defines the present invention, which may hereinafter be referred to as the "outrigging apparatus". The outrigging apparatus includes a "spar-member" being in combination; a basal padded end indicated generally at 4, an outer end indicated generally at 5, and a spar therebetween. generally indicated at 6. The outrigging apparatus additionally includes a "harness" being a combination of fore-and-aft outer tethers 3, and fore-and-aft basal tethers 2. The inboard ends of both pairs of tethers are fastened over the gunwale of the vessel to existing rail or deck hardware that can be conveniently tied to such as the cleat at 15.

As apparent in FIG. 1, only two onboard attachment sites are required, a forward site 13 for the forward outer and basal tethers, and an after site 14 for the after outer and basal tethers.

As seen in FIG. 1, the harness supports the spar member at each end. The basal tethers 2 connect at the basal padded end 4 of the spar-member 6. The outer tethers 3 connect with the outer end 5 of the spar-member 6. The tethers are normally made of flexible cordage or wire-rope that is durable and strong in tension.

Figure 2:
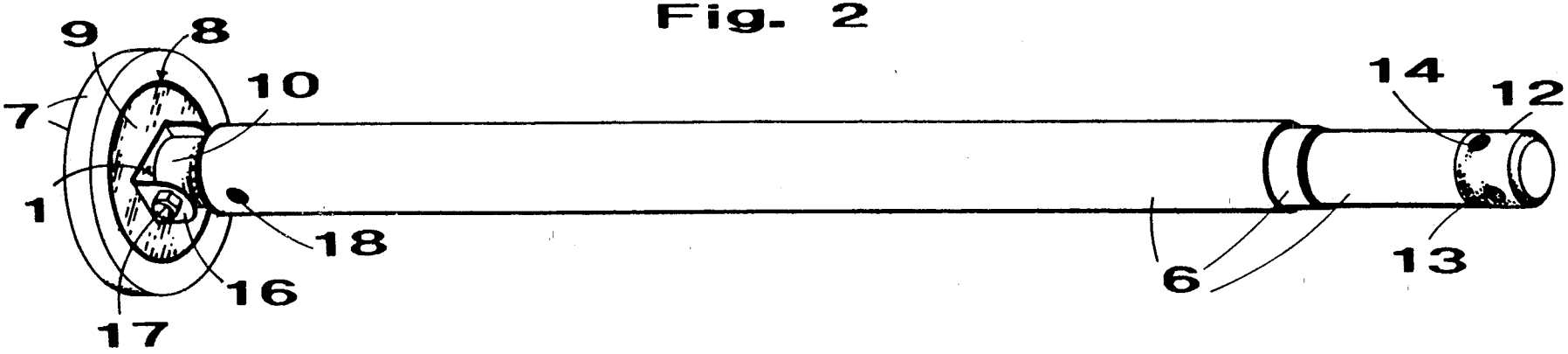
FIG. 2 is a pictorial view of the spar member telescopically retracted as it would be for storage, wherein the harness tethers have been omitted to show the features of the spar member more clearly.

The spar-member is illustrated in detail in FIG. 2. The spar 6, is formed from a stiff, light-weight material such as aluminum tubing, which is strong in compression, and non-corrosive. The spar is shown as a combination of three "telescoping" segments which are extended in FIG. 1, and retracted into each other in FIG. 2. Telescopic aluminum spars are widely used on boats to improve the stowability of the spar. The tubular segments are locked into an extended position or released by means of protrusional spring pins, as is well known in the art.

The basal end includes a substantially broad circular pad 7 surrounding a rigid circular reinforcing plate 9. The pad is normally a compressible polymer, and makes a flat cushioning surface for contacting the side of a vessel. The pad is formed to envelope all of the surface of the rigid plate except the exposed central area shown at 9, around which the pad terminates in a peripheral lip 8. The frontal exposed surface of the rigid plate 9 includes a centered bracket 16, which receives a horizontal pin 17, so that the rigid plate and pad may be hingedly connected to the butt-end of the spar.

A solid concentric end fitting hereinafter referred to as the "basal end-fitting" 10, intercalates into the lumen of the of the butt-end of the spar 6. The basal end-fitting 10 includes an exterior cap portion with a transverse horizontal bore through which the pin 17 is received, and a plug portion within the spar having a transverse horizontal bore 18 aligned with holes in the spar tubing 6 for reeving the basal tethers. The tethers may be stopped or fastened on either side of the bore by conventional means including a set-screw and/or knots.

The basal end-fitting 10 is mounted within the ears of the bracket 16 so that vertical rotation of the spar 6 about the horizontal pin 17 will occur depending on a gap generally indicated at 1, between the frontal face of the rigid plate 9 and the juxtaposed face of the basal end-fitting 10. The larger the gap between the rigid plate and basal end-fitting, the more the spar can rotate before the innermost edge of the basal end-fitting will impinge on the rigid plate or the base of the bracket, if the bracket 16 made as shown in FIG. 2.

A solid concentric end fitting hereinafter referred to as the "outer end-cap" 12, intercalates into the lumen of the spar tubing at the outermost end of the outrigger apparatus. Like the basal end-fitting 10 the outer end-cap 12 has an interior plug portion fitting within the tubular end of the spar 6 and an outer portion as seen at 12 The outer portion has a horizontal transverse bore 13 for the reeving of the outer tethers, and a vertical transverse bore 14 for the reeving of outboard rigging. The tethers can be stopped or fastened in the bore by conventional means including a set-screw and/or knot on each side of the bore.

The purpose of the outrigging apparatus is to effectively transmit loads from an outboard position to the hull and deck of the vessel. As seen in FIG. 1, the roll-dampening device 22 used as an example of outboard rigging will create heavy vertical loads when dragging against the rocking of the vessel 21. A downward substantially vertical load on the outer end of the spar-member 5 is converted to tension loads along the outer tethers 3 to the onboard attachment sites 14 and 15. This tension is countered by compression along the spar 6 to the basal padded end 4 which transfers the compression load into pressure against the vessels' topsides. This compression load is distributed by the rigid plate 9, and mitigated by the cushioning ability of the pad 7. Sheer forces at the basal-pad are absorbed by vertical tensions in the basal tethers 2, and frictional cohesion between the vessels' topsides and the elastic basal-pad surfaces. Thus, the outrigging apparatus operates statically, and is "self-stationing" by directing loads in a manner that increases the stability of the apparatus as the loads increase. In fact, the apparatus relies on the force of gravity for stationing stability when deployed, but not in use.

As apparent in FIG. 1, the outrigging apparatus could be easily moved forward to the attachment sites indicated at 30, or any combination of the onboard sites indicated at 14, 15, and 30 could be used. Multiple outrigging apparatuses could be stationed along the hull topsides. The outrigging apparatus is deployed by choosing any two sturdy onboard attachment sites that will allow sufficient spread between forward and after tethers to prohibit fore-and-aft sway of the outer end 5 of the spar member. Each pair of tethers should form a triangle, with the sides of the triangle converging on the spar-member securing positions 13 and 18, and with each side diverging to the two attachment sites on the vessel. The tethers may then be loosely attached and the spar member set over the side of the vessel.

As illustrated in FIG. 1, normally the basal tethers are adjusted so that the basal padded end 4 sets above the waterline, and equidistant from the two attachment sites, in this case represented by 14 and 15. The outer tethers 3 are normally then adjusted so that the spar 6 is perpendicular to the side of the vessel with the basal pad 7 flatly pressing on the hull topside surface. Final adjustments include setting the outer end of the spar higher than the basal end, whereby the spar extends at a substantially upward angle from its hinge at the basal pad. This is preferable so that compressive thrust from the spar into the basal pad has a downward component. Once these adjustments have been made, subsequent deployments using the same attachment sites are reduced to dropping the outrigging apparatus over the side. Retrieval or removal of the outrigging apparatus is limited to lifting it up and over the gunwale of the vessel.

The present invention as illustrated in FIG. 1 and FIG. 2 defines an embodiment that is producible at low cost, and universally suitable to a broad range of vessels. However it is anticipated that different modes may better suit particular demands on the invention. For instance, more than just two pairs of tethers could be used to distribute a larger load to more attachment sites on the vessel. The invention will function with a more reduced basal pad, if potential marring of the vessels' topsides is not an issue. A more stable base could be made by broadening the basal pad. By combining a plurality of pads for a wider stance on the vessels' topside, conceivably only one central tether would be required at the base of the spar and on at the tip, since fore-and-aft stability would occur solely along the basal pads. Means of receiving the outboard rigging can be integrated into the tip of the spar or the end cap and could include an internal sheave or block rather than a simple through-bore For means of attaching the tethers to the vessel, a vast number of knots or line fastening and/or adjusting devices well known in the art may be used.

It may be thus seen that the objects of the present invention set forth herein, as well as those made apparent from the foregoing description are efficiently attained. While preferred embodiments of the invention have been set forth for purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

We claim:

1. An outrigging apparatus for supporting outboard rigging and devices attached thereto laterally from the sides of floating vessels and platforms comprising:

a spar, wherein said spar includes a basal padded end, and an outer end for the fitting of outboard rigging;

a harness means to secure said spar to said floating vessels and platforms; and means for securing said harness means to said spar; whereby said spar is suspended by said harness means so that said basal padded end of said spar presses on the vessels side with said spar extended outwardly therefrom.

2. An outrigging apparatus as recited in claim 1, wherein said basal padded end includes a compressible surface normally comprising a resilient article such as an elastic polymer envelope, to ease contact between said basal padded end and the vessels side surface.

3. An outrigging apparatus as recited in claim 1, wherein said basal padded end normally includes a substantially broad, substantially flat, rigid plate including means to hingedly connect said spar perpendicularly to said plate.

4. An outrigging apparatus as recited in claim 1, wherein said spar normally sets on the hull topsides with said basal padded end pressed thereagainst near the waterline and beneath the rail of the floating vessel or platform.

5. An outrigging apparatus as recited in claim 1, wherein said spar is pivotally connected to said basal padded end, whereby said spar can rotate through a limited vertical angle by adjustments of said harness means, so that said spar normally maintains a substantially inclined attitude from base to tip while said basal padded end maintains substantially flat contact with the vessels' topside surface.

6. An outrigging apparatus as recited in claim 1, wherein said spar comprises a plurality of concentric telescopically intercalating tubular segments, wherein said segments may be extended to a maximum length and locked, or retracted to a minimum length for storage.

7. An outrigging apparatus as recited in claim 1, wherein said harness means comprises a pair of tethers secured to said basal padded end, and a pair of tethers secured to said outer end, whereby the free ends of both of said pairs of tethers are fastened to the vessel.

8. A harness means as recited in claim 7, wherein each tether of said pair of tethers, lead back on opposite sides of said spar at a diverging angle, so that each tether pair forms the sides of a triangle with its base formed along the vessels side and its apex formed at connections to the spar, wherein the bottom corners of the triangles thus formed are fastened to an available onboard attachment site to each side of the spar.

9. A harness means as recited in claim 8, whereby the adjustment of said pair of tethers attaching to said outer end of said spar normally maintains the perpendicular stationing of said spar relative to the vessels side.

10. An outrigging apparatus as recited in claim 1, wherein said spar will station on a vessels side without special hardware, supported by said harness means, wherein stationing stability is derived from a static balance of the tensions in said harness means opposing compression of said spar by the forces of gravity and outboard rigging.

11. An apparatus for universally outrigging outboard rigging and floating or submersible objects from the topsides of floating vessels comprising:

a basal end, which presses against the topside surface;

an outer end, including means for receiving said outboard rigging;

a rigid strut integrally extended between said basal end and said outer end;

a first harness means supporting said basal end over the side of said vessel from attachment positions onboard said vessel, whereby the said basal end is positioned juxtaposed to said side of said vessel;

a second harness means supporting said outer end from attachment positions onboard said vessel, whereby said rigid strut-member projects outwardly from said basal end substantially perpendicular to said side of said vessel and braces said outer end;

means for securing said first harness means to said basal end; and means for securing said second harness means to said outer end.

12. An outrigging apparatus as recited in claim 11, wherein said basal end includes padding means for cushioning contact and pressure on said topsides of said floating vessels.

13. An outrigging apparatus as recited in claim 11, wherein said basal end includes a substantially broad, soft surface which also functions as a pad, to cause static friction with said topsides to hinder inadvertent sliding thereon.

14. An outrigging apparatus as recited in claim 11, wherein said basal end of said rigid strut when deployed, is not structurally nor mechanically secured to said topsides.

* * * * *